United States Patent [19]

Lehmann

[11] Patent Number: 4,962,860

[45] Date of Patent: Oct. 16, 1990

[54] MERCHANDISING DISPLAY UNIT

[76] Inventor: Paul F. Lehmann, 1855 N. Custer Rd., Monroe, Mich. 48161

[21] Appl. No.: 417,475

[22] Filed: Oct. 5, 1989

[51] Int. Cl.[5] ..... A47F 5/08

[52] U.S. Cl. ..... 211/88; 211/86; 211/150

[58] Field of Search ..... 211/184, 86, 88, 150; 403/3, 4; 248/288.5

[56] References Cited

U.S. PATENT DOCUMENTS

| | | | |
|---|---|---|---|
| 1,552,510 | 9/1925 | Scofield | 211/88 |
| 1,554,137 | 9/1925 | Slifkin | 211/150 X |
| 1,589,198 | 6/1926 | McComb | 211/150 |
| 2,212,129 | 8/1940 | Rust | 211/88 X |
| 3,429,450 | 2/1969 | Lambert | 211/86 X |
| 3,635,161 | 1/1972 | Leanna | 211/184 X |
| 4,154,356 | 5/1979 | Schieve | 211/88 X |

FOREIGN PATENT DOCUMENTS

| | | | |
|---|---|---|---|
| 1013297 | 7/1977 | Canada | 211/88 |
| 1001938 | 10/1951 | France | 211/88 |

*Primary Examiner*—Carl D. Friedman

*Assistant Examiner*—Daniel Hulseberg

*Attorney, Agent, or Firm*—Willian Brinks Olds Hofer Gilson & Lione

[57] ABSTRACT

A merchandising display unit particularly suited for storing and displaying groups of small items of variable sizes such as nails, bolts and similar hardware. The basic unit includes an elongate horizontal channel having a rigid arcuate wall extending at least 180° around the horizontal axis to provide a partial enclosure having an upper elongate slot providing access and visibility to the contents therein. Each end of the channel has a fixed transverse barrier. One or more dividers are transversely positioned between the end barriers to provide separated segments or item compartments. Each divider is a rigid arcuate disc extending at least co-extensively with the arcuate wall of the channel and having an effective diameter slightly larger than that of the channel. Each divider may be placed anywhere along the axis of the channel to form item compartments of desirable length and each divider is maintained in its axial and transverse position by the open channel wall which must be slightly strained to receive the larger diameter disc.

4 Claims, 1 Drawing Sheet

MERCHANDISING DISPLAY UNIT

SUMMARY OF THE INVENTION

This invention is a merchandising display unit for small articles which is positioned upon a fixed support surface and extends horizontally across that surface, such as the edge of a storage or display shelf. The invention includes a horizontally extending channel-shaped body of arcuate cross section in which the channel body extends through an arc about its horizontal axis of between 180 and 270° to provide an open slot for access and visual inspection of the contents therein. The horizontal channel body is attached to the vertical shelf edge by one or more suitable fasteners extending through the wall of the channel.

The invention features horizontally adjustable dividers positioned between end barriers which serve to separate the horizontal body into compartments for holding individual items, such as hardware or other small items. The dividers are of circular or arcuate shape corresponding to the cross section of the channel body but have a slightly larger diameter so that they are firmly gripped when inserted within the arcuate body in transverse position.

BACKGROUND PRIOR ART

U.S. Pat. Nos. 4,047,615 and 4,154,356 both disclose a modular type merchandising display rack having a semi-circular or arcuate channel and intermediate fixed transverse dividers. U.S. Pat. No. 4,560,072 also shows a display and storage rack which can be mounted on a vertical surface and has provision for slidably mounting dividers along its length in various positions determined by grooves or shoulders in the inside surface of the shelf. U.S. Pat. No. 1,594,754 shows a display rack in which dividers are slidably movable along the length of the rack. None of these constructions include the advantages and objects of the invention, taken alone or in combination.

OBJECTS OF THE INVENTION

It is an object of this invention to provide a merchandising display unit of the type described in which the unit may be fabricated from lengths of extruded thermoplastic pipe and thus adopted to be co-extensive with the vertical surface or shelf edge to which it is mounted.

It is another object of this invention to provide such a display unit in which selectively movable dividers can be positioned anywhere along the axis of the unit, spaced apart by the exact desired length of the unit to be stored, for example, hardware such as bolts or nails.

It is still another object of this invention to provide such a divider which is fabricated from rigid thermoplastic material and is arcuate or circular in shape having a diameter slightly larger than that of the internal diameter of the pipe unit from which the channel unit is fabricated, such that the divider may be slightly forced into its transverse position, stressing the pipe unit as it opens slightly between its opposed open edges and continues to exert force on the divider to hold it in position.

It is yet another object of this invention to provide the adjustable length and adjustable divider storage unit as described above which can be mounted on the vertical edge of a shelf and rotated about its horizontal axis so that the open slot in the channel is facing generally horizontally or slightly upward, depending upon the type of units being stored and the position of the shelf above the floor, so that visual access into the interior of each such unit is possible for a viewer of normal height, etc.

Other objects and advantages of this invention will be apparent to those skilled in the art, from the following detailed description of a preferred embodiment thereof, with reference being made to the accompanying drawings.

DETAILED DESCRIPTION OF THE INVENTION

Figure 1:
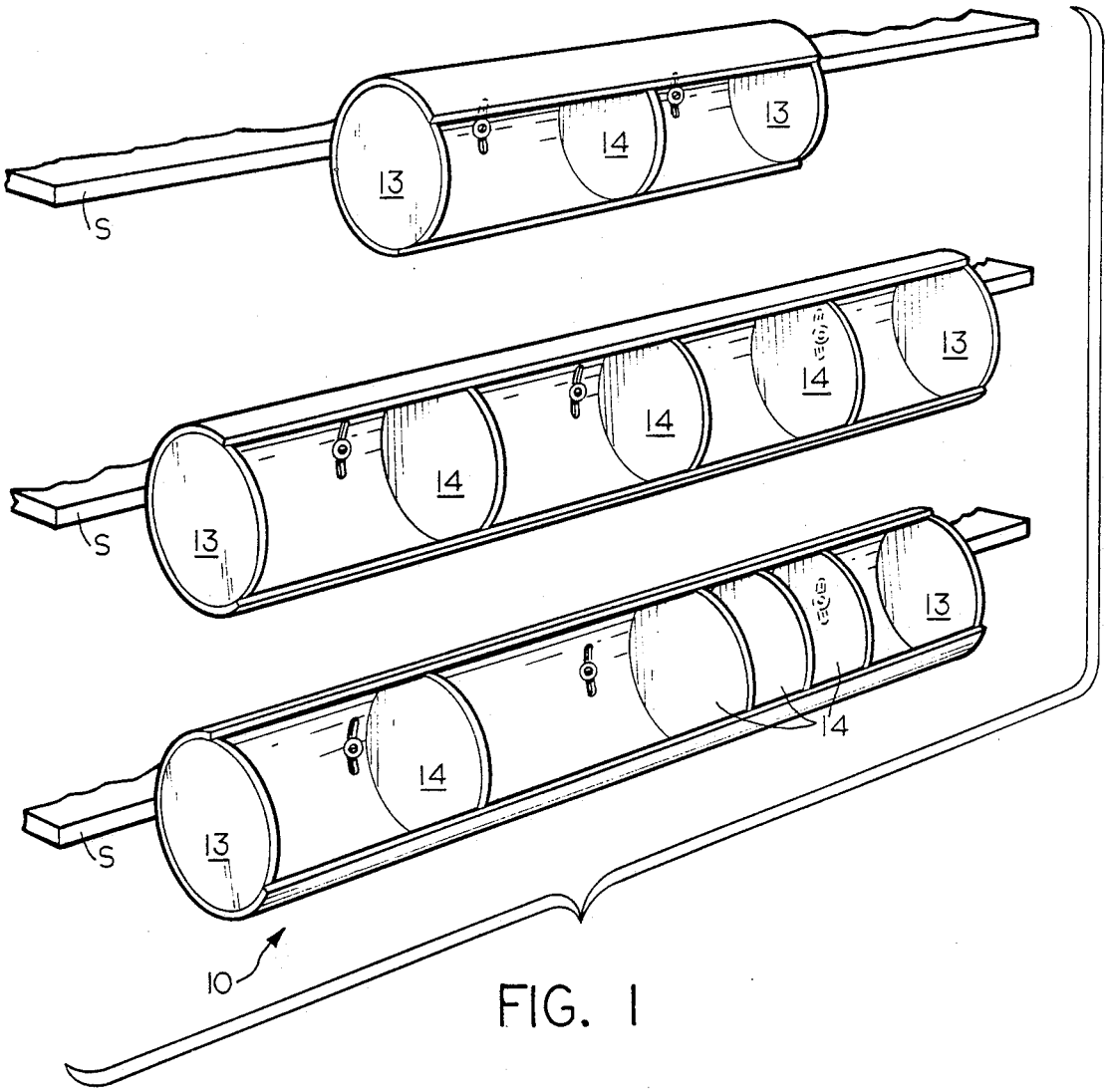
FIG. 1 is a view in perspective of the invention, showing three such shelves of different length being mounted upon the vertical face or edges of horizontal shelves and illustrating the manner in which dividers are selectively positioned to accommodate parts of selected length.

Referring to FIG. 1, each of the display units consists of an elongate channel 10 having a length corresponding to the shelf or vertical support surface to which it is attached. Commonly, these units will be attached to the edges of vertically stacked shelves and be co-extensive in length so that the parts displayed therein can be stored on the shelves in their boxes, with only a small number of parts being displayed in the unit.

The channel member itself is preferably fabricated from a length of extruded plastic pipe, such as three to eight inch diameter polyethylene pipe which is commonly made for liquid transport. The advantages of using such pipe are several: it is relatively inexpensive, readily available, can be cut and custom installed with portable hand tools, and comes in different colors so that an attractive display can be built. A relatively unskilled worker such as a store clerk or general handyman, can easily master installation of these units.

Once the desired length of the shelf has been determined and cut from the pipe, the unit itself is further formed by cutting an elongate slot to remove an arcuate portion of the pipe to provide access to the interior. As shown, the pipe has a slot of about 120° so that the remaining arc of the pipe is sufficient to provide a partially enclosed channel to hold the units and yet the slot of 120° provides enough space for visual inspection of the contents and manual access thereto. The slot can vary between 90 and 120° and still leave sufficient channel structure to keep parts from falling out although at least 200° is desirable as the minimum to grip the dividers, as seen below, enough of the arcuate wall to provide a enclosure to keep parts from falling out.

As best seen in FIG. 1, the extreme ends of the channel are closed by an end barrier 13 which may be permanently attached as with adhesive or other securing means. Intermediate the ends are a plurality of divider disks 14 which are positioned along the length of the channel to separate it into individual compartments. These discs have a thickness sufficient to prevent their twisting in the channel. For example, a disc of ⅜" material has been found to be satisfactory. One of the primary advantages of this invention is that the dividers 14 may be moved by the store stock boy or other employee to the exact length of the part being stored so that the display system is universal in that it can accommodate any size parts, etc. For example, if the display were to be used with bolts in a hardware store, each divider would be positioned so that the distance to an end barrier 13 or another divider would be exactly that necessary to receive a number of bolts of each particular length, placed in parallel horizontal position. As seen in FIG. 1, the boxes storing these bolts can be positioned directly above the compartment so that each compartment displays the parts which are contained in their shipping boxes immediately above.

Figure 3:
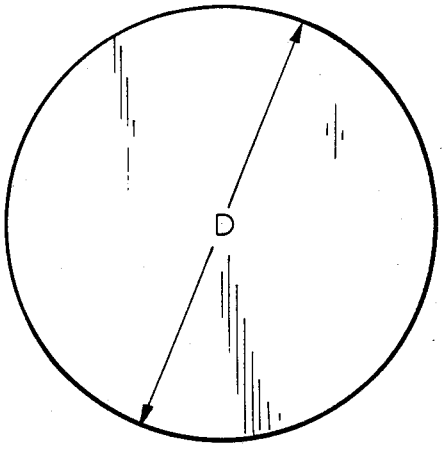
FIG. 3 is a plan view of one of the divider disks indicating its diameter in relation to the internal diameter of the shelf unit shown in FIG. 2.

The dividers 14 are composed of preferably the same thermoplastic material and are round or arcuate shaped of the same cross section as the channel. The outer diameter D of the divider 14, as shown in FIG. 3, is slightly larger than the unstressed inner diameter of the channel 10 or of the pipe forming it, so that when fully installed in its transverse position, the divider 14 is held in place and stresses the arcuate channel which opens slightly to grasp the divider and maintains force on it to hold it in position. As will be apparent, the force on the divider 14 is exerted by opposed edges of the channel which must extend at least 180° to maintain a grip on the divider 14.

Figure 2:
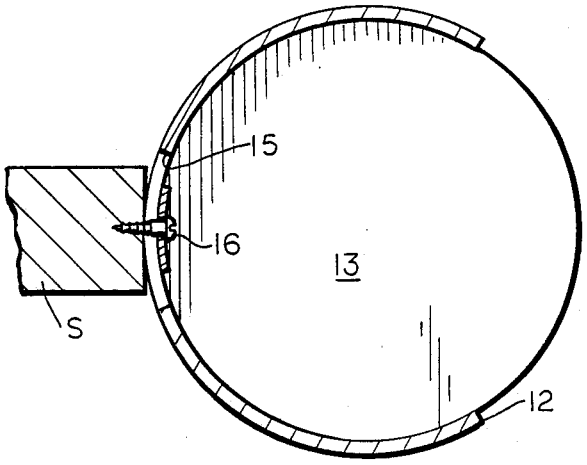
FIG. 2 is a view in cross section taken along line 2—2 of FIG. 1 and showing the manner in which the shelf unit is attached to its vertical support surface.

Another advantage of the instant system is illustrated in FIG. 1 in which three rows of the channel are shown mounted on stacked horizontally extending shelf edges. The uppermost channel is secured so that the slot, which is 120° in this instance, is slightly faced downwardly towards the floor. The middle row is turned slightly upwardly so that the slot faces outwardly or horizontally. The lower row is turned so that the slot faces slightly upwardly. This means that a customer or viewer may stand in one position and have good visual access to the interior of all the shelves without having to bend over or elevate his head for best vision. In effect, all of the slots are directed toward a common focal point which would be the elevation of the eyes of an average viewer. This is particularly advantageous when storing very small parts in which it is found necessary to reduce the size of the slot from 120° to 90° or less. Mounting the channel at different angular views is facilitated by a number of arcuate slots 15, seen in FIGS. 1 and 2, so that simple fasteners such as nuts and bolts or lag screws can be used to adjustably position the angle of the channel.

It will be apparent to those skilled in the art that the invention described above provides a number of advantages over the prior art display fixtures. Firstly, because it is fabricated from readily available lengths of thermoplastic pipe, a hardware store owner, clerk or semi-skilled installer can easily fabricate custom shelves. Secondly, because such pipes are available in a number of colors, attractive displays can be fabricated or the displays may be colored coded to indicate different items in different colors, such as metric threads in one color and English standard threads in another, etc. Thirdly, the divider disks 14 can also be fabricated from inexpensive thermoplastic sheets of different colors so that the start of one type of part can be indicated by a color on each end, etc. The provision of adjustment of the angle along the axis of the channel gives the shelves a useful advantage in that they can be stacked in high arrays and yet remain visible to the viewer without bending, etc. Finally, the readily adjustable dividers enable the shelves to be universally and repeatedly used for many items of varied size.

Other advantages of the invention will be apparent to those skilled in the art and various changes may be made from the above-described embodiment, without departing from the scope and spirit of the following claims.

I claim:

1. A merchandising display unit, comprising, in combination, an elongate horizontal channel of uniform interior diameter including a rigid arcuate wall extending at least 180° around a horizontal axis to form a partial enclosure with a bottom and opposed sides and an open top extending between the opposed horizontal edges of said sides, a fixed transverse barrier on each end of said channel, and at least one transverse divider intermediate said end barriers, each such divider comprising a rigid disc extending transversely across said channel and having an arcuate periphery at least coextensive with said arcuate channel wall, said disc having an effective diameter slightly larger than the interior diameter of such channel whereby, when said disc is placed transversely within said channel in any desired horizontal position, said channel will be slightly strained to receive and retain said disc and the opposed sides of said channel will exert sufficient force upon said disc to maintain its desired position.

2. A vertical array of merchandising display units comprising a plurality of units as defined in claim 1, with each such unit secured in horizontal position along the vertical face of a support surface, each such unit being in vertical alignment with the unit above or below it, and each such unit being secured such that its open top between said opposed horizontal edges is generally directed towards a common focal point such that an observer at such point may readily inspect the contents of each such unit without vertical movement from said focal point.

3. The merchandising display unit of claim 1 wherein said arcuate wall extends between 200° and 270° around the horizontal axis thereof.

4. The merchandising display unit of claims 1, 2 or 3 which further include a plurality of spaced apart arcuate slots extending through said wall generally intermediate said horizontal edges for receiving a fastening device secured to a vertical surface.

* * * * *